US011286584B2

(12) United States Patent
Braun et al.

(10) Patent No.: US 11,286,584 B2
(45) Date of Patent: Mar. 29, 2022

(54) BALE OPENER

(71) Applicant: Maschinenfabrik Rieter AG, Winterthur (CH)

(72) Inventors: Lukas Braun, Winterthur (CH); Gerhard Gschliesser, Winterthur (CH)

(73) Assignee: Maschinenfabrik Rietet AG, Winterthur (CH)

( * ) Notice: Subject to any disclaimer, the term of this patent is extended or adjusted under 35 U.S.C. 154(b) by 93 days.

(21) Appl. No.: 16/292,404

(22) Filed: Mar. 5, 2019

(65) Prior Publication Data

US 2019/0276953 A1 Sep. 12, 2019

(30) Foreign Application Priority Data

Mar. 7, 2018 (CH) ..... 00277/18

(51) Int. Cl.

| | |
|---|---|
| ***D01G 7/04*** | (2006.01) |
| ***D01G 7/12*** | (2006.01) |
| ***D01G 7/06*** | (2006.01) |
| ***D01G 31/00*** | (2006.01) |

(52) U.S. Cl.

CPC ..... *D01G 7/04* (2013.01); *D01G 7/06* (2013.01); *D01G 7/12* (2013.01); *D01G 31/00* (2013.01)

(58) Field of Classification Search

CPC ..... D01G 7/04; D01G 7/06; D01G 31/00; D01G 7/12; D01G 7/02; D01G 7/10; D01G 7/14

USPC ..... 19/80 R

See application file for complete search history.

(56) References Cited

U.S. PATENT DOCUMENTS

| | | | | | |
|---|---|---|---|---|---|
| 4,477,944 | A * | 10/1984 | Binder | D01G 7/12 | 19/80 R |
| 4,707,888 | A * | 11/1987 | Binder | D01G 7/10 | 19/80 R |
| 4,984,336 | A * | 1/1991 | Hanselmann | D01G 7/12 | 19/80 R |
| 5,221,053 | A * | 6/1993 | Pinto | D01G 7/04 | 19/80 R |
| 2016/0108558 | A1* | 4/2016 | Schmid | D01G 7/10 | 19/80 R |
| 2016/0108559 | A1 | 4/2016 | Schmid et al. | | |
| 2017/0298541 | A1 | 10/2017 | Gschliesser | | |

FOREIGN PATENT DOCUMENTS

| | | |
|---|---|---|
| CH | 710 257 | 4/2016 |
| EP | 2 322 701 A1 | 5/2011 |
| EP | 3 009 539 A1 | 4/2016 |
| EP | 3 239 368 A1 | 11/2017 |

(Continued)

OTHER PUBLICATIONS

Swiss Patent Office Search Report, dated Jul. 3, 2018.

*Primary Examiner* — Khoa D Huynh
*Assistant Examiner* — Aiying Zhao
(74) *Attorney, Agent, or Firm* — Dority & Manning, P.A.

(57) ABSTRACT

A take-off arm is provided for a bale opener for taking off fiber flocks from fiber bales. The take-off arm includes a housing, and a take-off unit having an axial length within the housing. A pressing element is connected to the housing via only load cells such that a contact force (F) of the take-off arm on the fiber bales is continuously measured by an evaluation of the load cells situated between the pressing element and the housing.

6 Claims, 3 Drawing Sheets

(56) References Cited

FOREIGN PATENT DOCUMENTS

| | | | | |
|---|---|---|---|---|
| JP | S 6375122 | A | 4/1988 | |
| WO | WO 91/05090 | | 4/1991 | |
| WO | WO-2009062325 | A1 * | 5/2009 | ..... D01G 7/04 |

* cited by examiner

BALE OPENER

FIELD OF THE INVENTION

The invention relates to a take-off arm for a bale opener for taking off fiber flocks from fiber bales, having a housing, a detaching roller, and a pressing element, and to a bale opener and to a method for taking off fiber flocks from fiber bales, using a bale opener.

BACKGROUND

Bale take-off machines or bale openers are used to extract fibers or fiber flocks from pressed fiber bales. For this purpose, a take-off unit is moved across the fiber bales. The take-off unit is fastened to a take-off arm, the height of which is set according to the fiber bales that are present. The take-off arm in turn is mounted on a take-off tower. The take-off tower allows the take-off unit to be moved across the surface of the fiber bales to be stripped. For this purpose, the take-off tower is situated on a chassis or a rotating frame. A chassis, which is usually guided on rails, may be used to move across a row of bales. If the fiber bales are arranged in a circle around the take-off tower, the take-off tower is mounted on a rotating frame. A combination of a chassis and a rotating frame is present when fibers or fiber flocks are extracted from a first row of fiber bales in one direction and from a second row of fiber bales in the opposite direction.

The bale opener is located at the beginning of processing lines in a spinning preparation (blow room) for processing fiber material, for example cotton or synthetic fibers or mixtures thereof, and has a decisive influence on the continuity of the sequences within the spinning preparation. In the bale opener, the fiber material delivered in bales is extracted from the bales by taking off fiber flocks, and is transferred to a pneumatic transport system. The pneumatic transport system carries the fiber flocks through pipelines to the downstream cleaning machines.

In bale openers that are common nowadays, the take-off arm is mounted on the take-off tower so as to be vertically adjustable. The vertical adjustment takes place by means of chain drives, belt drives, or spindle drives by which the take-off arm is raised or lowered. Various sensors are provided for determining the position of the take-off arm relative to the surface of the fiber bales. The take-off performance of the take-off unit contained in the take-off arm results from the position of the take-off arm relative to the surface of the fiber bales.

Various designs for controllers for take-off arms, and thus for the take-off performance, are known from the prior art. For example, EP 2 322 701 A1 discloses a bale opener that controls the take-off process with a preferably constant take-off force. The torques of the drive motors of the take-off unit and of the height adjustment of the take-off arm are regulated. In addition, correction factors such as height and composition of the fiber bales are to be taken into account. A disadvantage of this method is that, due to adjustment values of various components, conclusions are drawn concerning the take-off force without actually knowing it. As the result of changing operating conditions over time, or provision with new fiber bales, the system is unreliable without adjustment of the correction factors.

EP 3 009 539 A1 discloses a bale opener in which the weight of the take-off arm is measured using a load cell. When the take-off arm comes to rest on the fiber bales, its weight is reduced, or the take-off arm is even lifted. Take-off arms contain the take-off unit, usually one or more detaching rollers together with the associated drive units, resulting in a total weight of the take-off arm of greater than 500 kg, even for fairly small systems. This reduction in weight is equal to a bearing force of the take-off arm on the fiber bales. A disadvantage of this design is that the operating conditions for the lifting motion of the take-off arm change over an extended period of operation. For example, measuring errors result due to wear of the guides of the take-off arm or the occurrence of vibrations in the chassis of the take-off tower, since the load cell is integrated into the lifting mechanism of the take-off arm, and therefore is also connected to the take-off tower.

SUMMARY OF THE INVENTION

An object of the invention is to provide a bale opener having a take-off arm that allows reliable, directly controllable vertical adjustment and positioning of the take-off arm, free of influences from the design of the take-off arm. A further object of the invention is to provide a method for a reliably controllable take-off quantity of fiber flocks from fiber bales, using a bale opener. Additional objects and advantages of the invention will be set forth in part in the following description, or may be obvious from the description, or may be learned through practice of the invention.

The objects are achieved by the features of the invention described and claimed herein.

For achieving the objects, a force-dependent vertical adjustment of the take-off arm for a bale opener for taking off fiber flocks from fiber bales is proposed. The take-off arm has a housing, at least one detaching roller having an axial length, and a pressing element. The pressing element is connected to the housing via load cells. The fastening of the pressing element to the housing, and thus to the take-off arm, is ensured only via the load cells. The pressing element is mounted on the take-off arm in such a way that the pressing element contacts the fiber bales when the take-off arm is lowered onto the fiber bales. Upon further lowering of the take-off arm after initial contact of the pressing element with the surface of the fiber bales, the pressing element is pressed onto the fiber bales by the intrinsic weight of the take-off arm. As a result of the pressing element being connected to the housing of the take-off tower via load cells, the reduction of the intrinsic weight of the take-off arm due to the support by the fiber bales is registered via the load cells. The contact force with which the take-off arm acts on the fiber bales may be appropriately measured by the load cells. It has been shown that use of four load cells to compensate for tilted positions is advantageous. Since the surfaces of the fiber bales do not form a uniform or parallel plane with respect to the pressing element, the actual bearing force exerted by the pressing element on the fiber bales is not equal at all locations on the pressing element. However, when multiple load cells are used, this situation is compensated for by the evaluation unit, and a contact force may be determined which is independent of the position of the take-off arm or the pressing element. In addition, influencing of the lifting mechanism or of the guides of the take-off arm is excluded by directly measuring the contact force on the pressing element.

Various designs of so-called force transducers may be used in the load cells. For example, the use of force transducers is known, in which the force acts on an elastic spring body and deforms it. The deformation of the spring body is converted into a change in voltage, using strain gauges whose electrical resistance changes with the strain. The voltage, and thus the change in strain, are recorded via a measuring amplifier. This value may be converted into a measured force value, based on the elastic properties of the spring body. Bending beams, annular torsion springs, or other designs are used as spring bodies. In another design of load cells, piezoceramic elements are used. Microscopic dipoles form within the unit cells of the piezocrystal due to the directed deformation of a piezoelectric material. Summing over the associated electrical field in all unit cells of the crystal results in a macroscopically measurable voltage that can be converted into a measured force value. Load cells are known from the prior art, and are currently widely used in force and weight measurement.

The pressing element is advantageously designed as a grid having hold-down plates, and the take-off unit is designed as a detaching roller having take-off teeth. The grid is situated below the detaching roller, and the detaching roller engages with the take-off teeth through the grid. The grid mounted below the detaching roller represents the actual contact point with the surface of the fiber bales. The hold-down plates mounted on the grid in the travel direction of the take-off tower are used to guide the fiber flocks, which are standing up on the surface of the fiber bales, beneath the grid during a travel motion of the take-off tower, and thus, of the take-off arm. For this purpose, the hold-down plates are guided obliquely upwardly away from the grid. For a detaching roller that is usable on both sides, corresponding hold-down plates are mounted on both sides of the grid. The hold-down plates together with the grid form the pressing element. The take-off teeth of the detaching roller engage through the grid, and extract fiber flocks from the surface of the fiber bales due to the rotary motion of the detaching roller. As a result of the rotary motion of the detaching roller, the take-off teeth are moved by the fiber bales, and therefore do not assist in supporting the take-off arm on the fiber bales.

The grid advantageously has a length that corresponds at least to the axial length of the detaching roller on which the detaching roller is provided with take-off teeth. The grid thus also has the function of preventing the take-off teeth from tearing excessively large fiber flocks from the fiber bales. The length of the grid, and thus also of the hold-down plates, ensures that the pressing element formed by the grid and the hold-down plates comes to rest on the fiber bales over the entire axial length of the detaching roller. The result is uniform take-off on the surface of the fiber bales.

In one alternative embodiment, the pressing element is designed as a guide plate. In one design of the take-off unit, having a grid that does not rest on the surface of the fiber bales, the guide plates represent the contact between the take-off arm and the fiber bales, and are appropriately connected to the take-off arm via load cells for measuring the contact force. In this case, the grid is used solely to prevent the take-off teeth from tearing excessively large fiber flocks from the fiber bales.

In another alternative embodiment, the pressing element is designed as multiple guide rails that are situated beneath the grid and that slide over the fiber bales. The grid itself does not rest on the fiber bales. The guide rails in turn are mounted on the take-off arm via load cells. Necessary hold-down plates may be fastened to the guide rails to avoid incorrect measurement of the contact force due to the fiber flocks, on the surface of the fiber bales, that run in in the area of the detaching roller. The guide rails may also be designed as grids that cover a portion of the axial length of the detaching roller. In this case, the grid is provided between the guide rails and the detaching roller only at locations where no guide rails in the form of partial grids are situated.

In another alternative embodiment, the pressing element is designed as at least one pressing roller having bearing shields, and the load cells are situated on the bearing shields of the pressing roller. Instead of the guide plates, pressing rollers are used to ensure the run-in of the surfaces of the fiber bales beneath the take-off unit. When the take-off arm moves across the fiber bales, the surface of the fiber bales is made uniform by the pressing roller before the take-off unit engages with the surface.

Magnets for separating metallic impurities from the fiber bales are advantageously mounted on the pressing element. The magnets can be provided on the hold-down plates, along the entire axial length of the take-off unit. The magnets may be mounted as a plurality of individual magnets or as a strip magnet that extends over the entire length of the take-off unit. Strip magnets in the form of foils are often used in the prior art. As a result of the magnets, metallic impurities that could cause damage on the take-off unit or in a subsequent process stage may be retained even before the fiber flocks are extracted from the fiber bales. Cleaning of the magnets may be provided, for example, at the end of a row of fiber bales. The cleaning may be performed by hand or by an automated cleaning device. When strip magnets are used, it is also easily possible to replace the used strip with a new, cleaned strip. As an alternative to magnet strips, magnetic drums may be used. Magnetic drums may be mounted on both sides of the pressing element, or also on the take-off arm. The magnetic drums may have a self-cleaning system; for example, during rotation of the take-off arm, when the direction changes, the magnets are deactivated in a position remote from the fiber bales, and the drums are cleaned in this way.

Also proposed is a bale opener having a take-off arm according to the above description.

To further achieve the objects, a method for taking off fiber flocks from fiber bales, using a bale opener, is proposed, the bale opener having a take-off arm with a housing, at least one detaching roller, and a pressing element. A contact force of the take-off arm on the fiber bales is continuously measured by an evaluation of load cells situated between the pressing element and the housing.

By using a load cell, it is possible to move the take-off tower across the surface of the fiber bales at a specified pressure. A contact force of the take-off arm on the fiber bales is determinable via the load cells. The take-off arm together with the pressing element fastened thereto is lowered onto the surface of the fiber bales until a certain load is determined via the load cells. The load corresponds to the contact force with which the pressing element, situated on the take-off arm, is pressed onto the surface of the fiber bales. The pressure by which the pressing element is pressed onto the fiber bales, the state and the working speed of the take-off unit, and the travel speed of the take-off tower by which the take-off arm is guided across the fiber bales essentially determine the take-off quantity. The take-off quantity of the bale opener may now be directly influenced by a direct measurement of the contact force and an associated control of the lifting mechanism of the take-off arm. Due to the fact that the fiber bales cannot be uniformly stripped by the take-off operation, height differences result between the individual fiber bales or also within fiber bales. If the level of a fiber bale surface now increases, the contact force also increases. This is registered by the load cells, and the control may respond by appropriately lifting the take-off arm.

By calibration, a zero value for the contact force is advantageously determined by measuring forces that act on the load cells due to the intrinsic weight of the pressing element. In a position of the take-off arm that is remote from the surface of the fiber bales, by fastening the pressing element to the housing of the take-off arm the load cells are placed under load by the intrinsic weight of the pressing element. If the take-off arm is now lowered onto the fiber bales, the load cells are initially relieved of load by the magnitude of the intrinsic weight of the pressing element. However, the relief of load results in a pressure on the surface of the fiber bales, which must be taken into account in determining the bearing pressure.

BRIEF DESCRIPTION OF THE DRAWINGS

The invention is explained in greater detail below based on exemplary embodiments and with reference to the drawings, which show the following.

DETAILED DESCRIPTION

Figure 1:
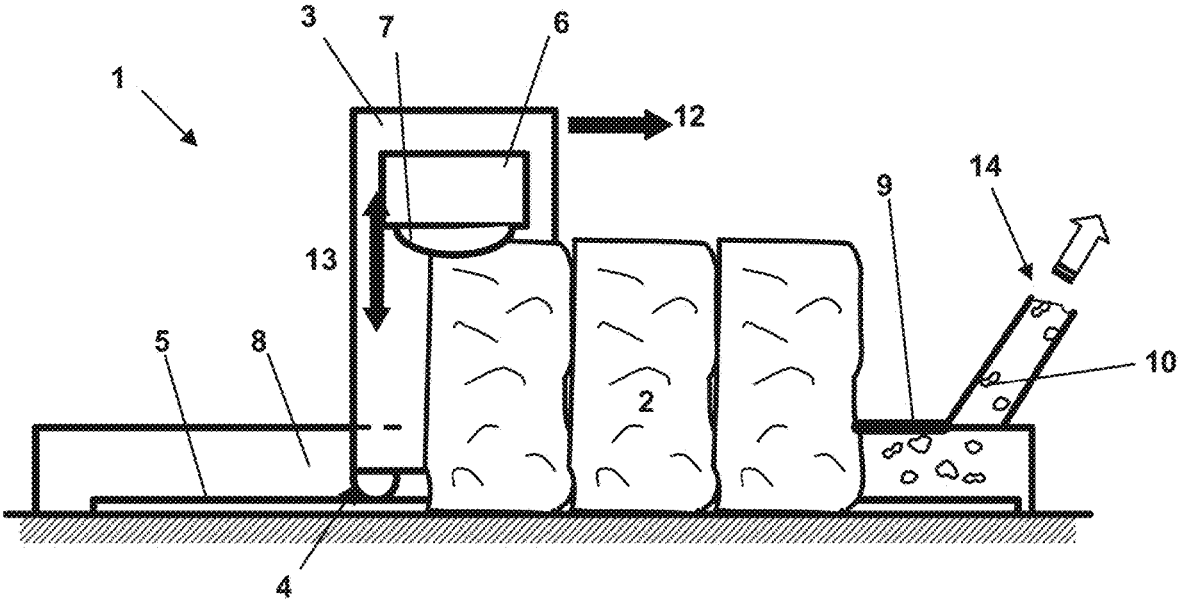
FIG. 1 shows a schematic illustration of a bale opener in a frontal view.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
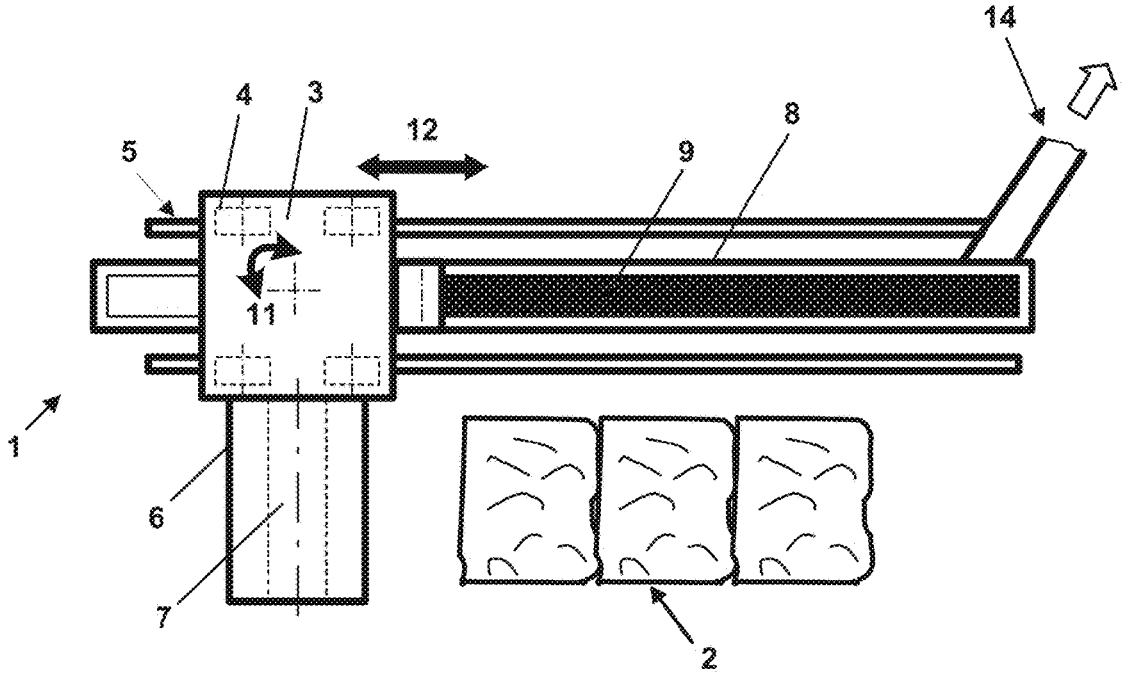
FIG. 2 shows a schematic illustration of a bale opener in a top view.

FIGS. 1 and 2 show a schematic illustration of a bale opener 1 according to the prior art for taking off fiber flocks 10 from fiber bales 2. FIG. 1 shows the bale opener 1 in a frontal view, and FIG. 2, in a top view. The bale opener 1 is made up essentially of a take-off tower 3 and a take-off arm 6. The take-off arm 6 is fastened to one side of the take-off tower 3, and projects freely across the fiber bales 2. The take-off tower 3 is equipped with a chassis 4. The take-off tower 3 is moved along the fiber bales 2 on rails 5 by means of the chassis 4. As a result of this movement 12, the take-off arm 6 mounted on the take-off tower 3 is guided across the surface of the fiber bales 2. A take-off unit 7 is situated in the take-off arm 6. The take-off unit 7 removes fiber flocks 10 from the fiber bales 2. The fiber flocks 10 are brought by the take-off arm 6 and the take-off tower 3 to a conveying channel 8. The conveying channel 8, and thus also the transport path from the take-off unit 7 to the conveying channel 8, are under a certain negative pressure that is used to pneumatically convey the fiber flocks 10 from the take-off unit 7 through the conveying channel into a pneumatic fiber flock transport system 14. The conveying channel 8 is closed between the take-off tower 3 and the fiber flock transport system 14 by a channel cover 9. During a travel motion 12 of the take-off tower 3, the channel cover 9 is rolled on and off, so that the conveying channel 8 in its active length, which continuously changes due to the travel motion 12 of the take-off tower 3, is closed by the channel cover 9.

The fastening of the take-off arm 6 to the take-off tower 3 has a height-adjustable design, so that the fiber bales 2 may be continuously stripped. The movement 13 of the take-off arm 3 serves to ensure uniform take-off of the fiber flocks 10 from the surface of the fiber bales 2. When the take-off tower 3 with its travel motion 12 has traveled across all fiber bales 2, the direction of the travel motion 12 of the take-off tower 3 may be reversed. When fiber bales 2 are provided for take-off on both sides of the conveying channel 8, as the result of a rotary motion 11 the take-off tower may swivel the take-off arm 6 to the other side of the conveying channel 9.

Figure 3:
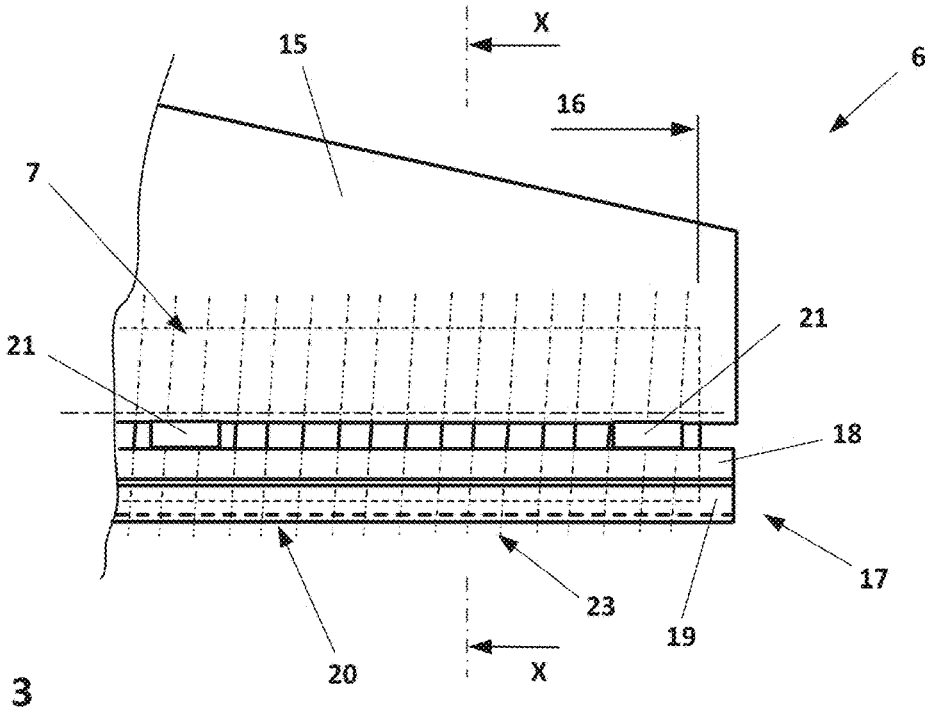
FIG. 3 shows a schematic illustration of a first embodiment of a take-off arm according to the invention in a partial view.
Figure 4:
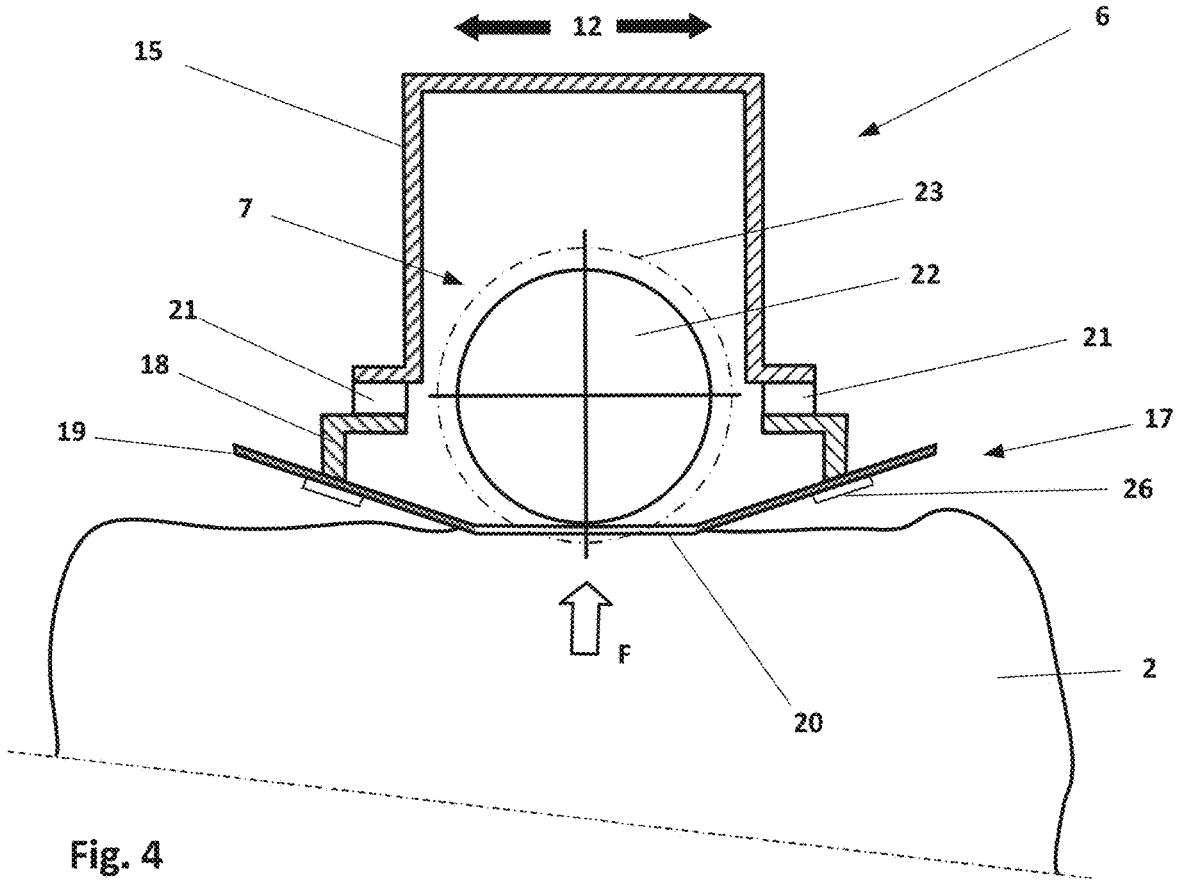
FIG. 4 shows a schematic sectional illustration at location X-X according to FIG. 3.

FIG. 3 shows a schematic illustration of a first embodiment of a take-off arm 6 according to the invention in a partial view, and FIG. 4 shows a schematic sectional illustration at location X-X according to FIG. 3. The take-off arm 6 has a housing 15, and a take-off unit 7 situated within the housing 15. The take-off unit 7 has a detaching roller 22 having an axial length 16 and take-off teeth 23 situated on its surface over the axial length 16. The take-off teeth 23 may be designed as individual teeth, or in the form of toothed disks. A pressing element 17 made up of a mounting 18, a hold-down plate 19, and a grid 20 is situated below the housing 15. The length of the pressing element 17 exceeds the axial length 16 of the detaching roller 22 in order for the fiber bales 2 to properly travel across in their entire extent. Based on the illustrated design of the bale opener 1 in FIGS. 1 and 2, a hold-down plate 19 is illustrated in each case, corresponding to the possible travel motions 12 on both sides of the grid 20. The hold-down plates 19 are connected to the grid 20, and together with the grid 20 are mounted on the mountings 18. The mountings 18 in turn are fastened to load cells 21, the load cells 21 being secured to the housing 15 of the take-off arm 6. The pressing element 17 is thus coupled to the housing 15 of the take-off arm 6 only via the load cells 21, without further connection.

FIG. 4 also illustrates the fiber bale 2 to be stripped, to which the take-off arm 6 applies the contact force F via the pressing element 17. Due to the irregular height of the fiber bale 2, the contact force F is not necessarily uniformly distributed over the entire surface area of the pressing element 17. However, the nonuniform distribution of the contact force F is compensated for by the arrangement of four load cells 21. The greater the contact force F, the more strongly the upper portion of the fiber bale 2 to be stripped is compressed, and higher take-off performance is achieved by the engagement of the take-off teeth 23 of the detaching roller 22 with the fiber bale 2. The actual penetration depth of the take-off teeth 23 into the fiber bale 2 is determined by the grid 20 that rests on the surface of the fiber bale. It is necessary to adjust the distance between the grid 20 and the detaching roller 22 in order to adjust the engagement depth of the take-off teeth 23 into the fiber bale 2.

FIG. 4 also shows magnets 26 on the hold-down plates 19 for separation of metal particles. The metal particles situated on the surface of the fiber bale 2 are retained by the magnets, and thus do not enter the area of the take-off teeth 23.

Figure 5:
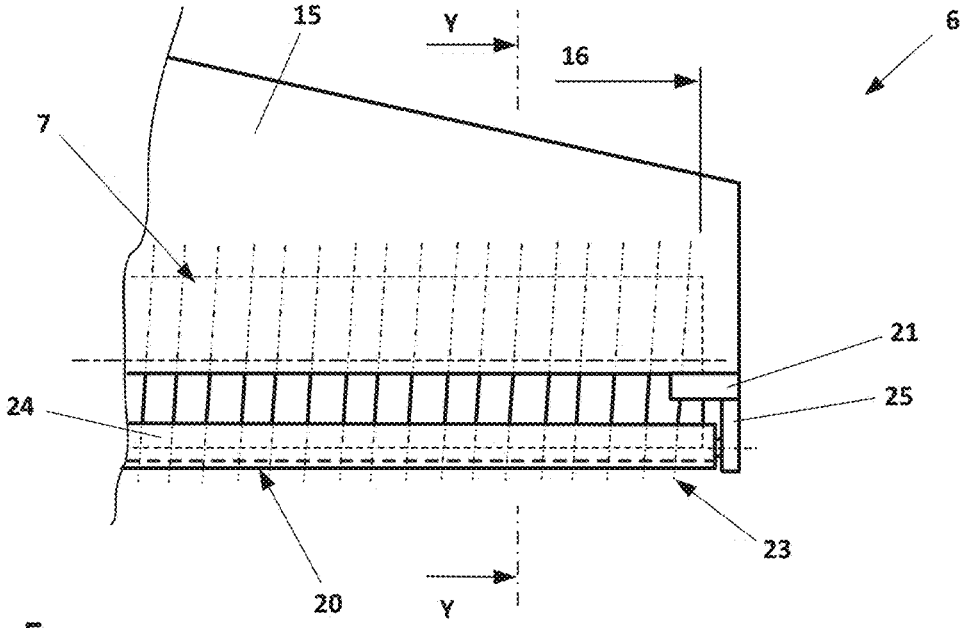
FIG. 5 shows a schematic illustration of a second embodiment of a take-off arm according to the invention in a partial view.
Figure 6:
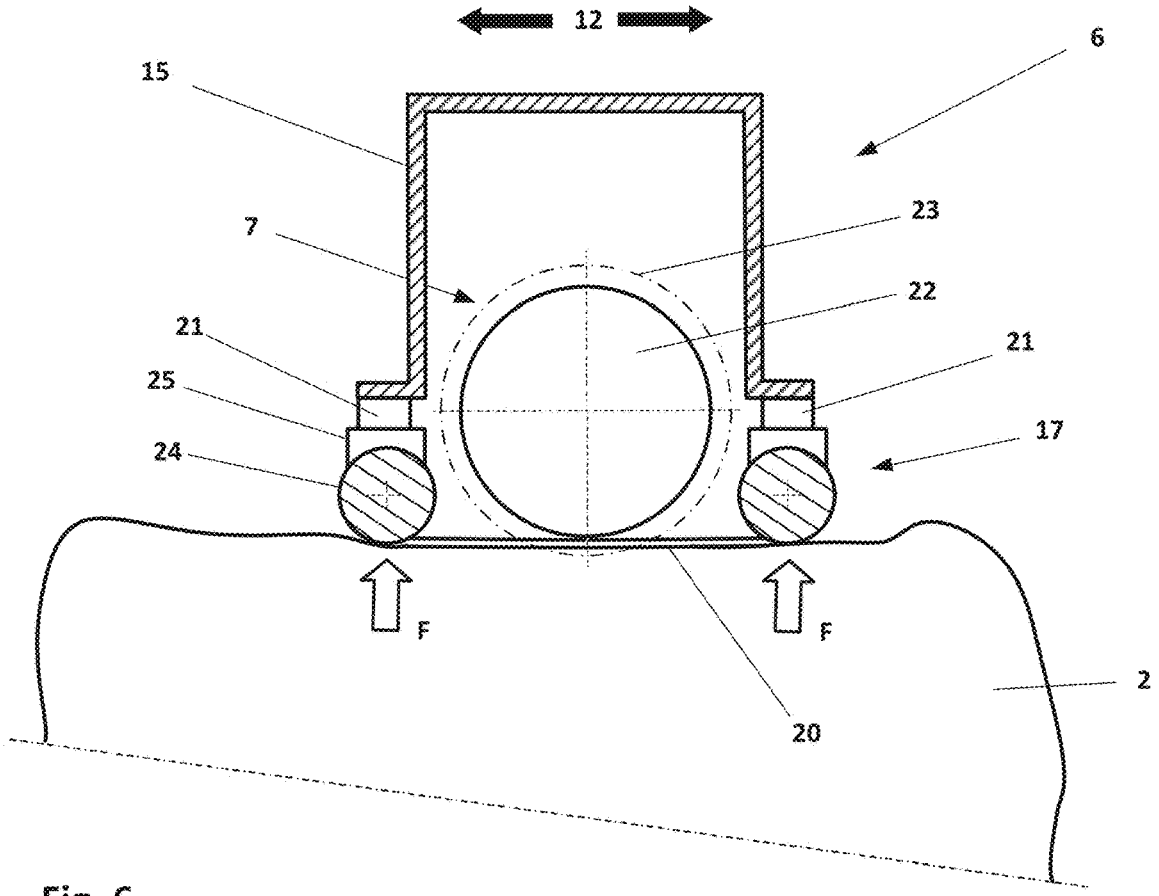
FIG. 6 shows a schematic sectional illustration at location Y-Y according to FIG. 5.

FIG. 5 shows a schematic illustration of a second embodiment of a take-off arm according to the invention in a partial view, and FIG. 6 shows a schematic sectional illustration at location Y-Y according to FIG. 5. The take-off arm 6 has a housing 15 and a take-off unit 7 situated within the housing 15. The take-off unit 7 has a detaching roller 22 having an axial length 16, and take-off teeth 23 situated on its surface.

The take-off teeth 23 may be designed as individual teeth, or in the form of toothed disks. A pressing element 17 made up of a pressing roller 24 that is mounted in bearing shields 25, and a grid 20 is situated below the housing 15. The length of the pressing element 17 exceeds the axial length 16 of the detaching roller 22 in order for the fiber bales 2 to properly travel across in their entire extent. Based on the illustrated design of the bale opener 1 in FIGS. 1 and 2, a pressing roller 24 is illustrated in each case, corresponding to the possible travel motions 12 on both sides of the grid 20. The grid 20 is likewise mounted on the bearing shields 25. The bearing shields 25 in turn are fastened to load cells 21, the load cells 21 being secured to the housing 15 of the take-off arm 6. The pressing element 17 is thus coupled to the housing 15 of the take-off arm 6 only via the load cells 21, without further connection.

FIG. 6 also illustrates the fiber bale 2 to be stripped, to which the take-off arm 6 applies the contact force F via the pressing element 17 and the pressing rollers 24. Due to the irregular height of the fiber bale 2, the contact force F is not necessarily uniformly distributed over the two pressing rollers 24 or their axial length. However, the nonuniform distribution of the contact force F is compensated for by the arrangement of four load cells 21. The greater the contact force F, the more strongly the upper portion of the fiber bale 2 to be stripped is compressed by the pressing rollers 24, and higher take-off performance is achieved by the engagement of the take-off teeth 23 of the detaching roller 22 with the fiber bale 2. The actual penetration depth of the take-off teeth 23 into the fiber bale 2 is determined by the grid 20 that rests on the surface of the fiber bale 2. It is necessary to adjust the distance between the grid 20 and the detaching roller 22 in order to adjust the engagement depth of the take-off teeth 23 into the fiber bale 2.

Modifications and variations can be made to the embodiments illustrated or described herein without departing from the scope and spirit of the invention as set forth in the appended claims.

LIST OF REFERENCE NUMERALS

1 bale opener
2 fiber bales
3 take-off tower
4 chassis
5 rails
6 take-off arm
7 take-off unit
8 conveying channel
9 channel cover
10 fiber flocks
11 rotary motion of the take-off tower
12 travel motion of the take-off tower
13 movement of the take-off arm
14 fiber flock transport system
15 housing
16 axial length of the take-off unit
17 pressing element
18 mounting
19 hold-down plate
20 grid
21 load cell
22 detaching roller
23 take-off teeth
24 pressing roller
25 bearing shield
26 magnet
F contact force

The invention claimed is:

1. A take-off arm for a bale opener for taking off fiber flocks from fiber bales, the take-off arm configured to be controllably raised and lowered on the bale opener, comprising:

a housing;

a take-off unit having an axial length, the take-off unit comprising a detaching roller having take-off teeth;

a pressing element connected to the housing via only load cells such that a contact force of the pressing element on the fiber bales is directly and continuously measured by the load cells, the pressing element comprising a grid configured with hold-down plates;

wherein the grid is situated below the detaching roller, and the take-off teeth of the detaching roller engage with the fiber flocks through the grid; and wherein a height of the take-off arm on the bale opener is controlled based on the measured contact force.

2. The take-off arm according to claim 1, wherein the grid has a length that corresponds at least to an axial length of the detaching roller.

3. The take-off arm according to claim 2, wherein the hold-down plates are provided on both sides of the grid over the entire length of the grid.

4. The take-off arm according to claim 1, further comprising magnets for separating metallic impurities from the fiber bales mounted on the pressing element.

5. A bale opener, comprising a take-off arm according to claim 1.

6. The take-off arm according to claim 1, further comprising magnets for separating metallic impurities from the fiber bales mounted on the hold-down plates.

* * * * *